US006877334B2

(12) United States Patent
Hiramatsu

(10) Patent No.: US 6,877,334 B2
(45) Date of Patent: Apr. 12, 2005

(54) COOLING UNIT AND MANUFACTURING METHOD OF THE SAME

(75) Inventor: Shinya Hiramatsu, Aichi-ken (JP)

(73) Assignee: Hoshizaki Denki Kabushiki Kaisha, Aichi (JP)

( * ) Notice: Subject to any disclaimer, the term of this patent is extended or adjusted under 35 U.S.C. 154(b) by 0 days.

(21) Appl. No.: 10/345,972

(22) Filed: Jan. 17, 2003

(65) Prior Publication Data

US 2004/0139761 A1 Jul. 22, 2004

(51) Int. Cl.[7] ..... F25C 1/14

(52) U.S. Cl. ..... 62/354; 165/156; 29/460; 29/527.3; 29/527.5

(58) Field of Search ..... 62/354; 165/133, 165/156, 91, 97; 29/460, 527.3, 527.5

(56) References Cited

U.S. PATENT DOCUMENTS

| | | | | | |
|---|---|---|---|---|---|
| 3,844,134 | A | * | 10/1974 | Krueger et al. | 62/354 |
| 4,061,184 | A | * | 12/1977 | Radcliffe | 165/286 |
| 4,250,718 | A | * | 2/1981 | Brantley | 62/354 |
| 4,276,750 | A | * | 7/1981 | Kawasumi | 62/137 |
| 4,739,630 | A | * | 4/1988 | Tandeski et al. | 62/354 |
| 4,741,173 | A | * | 5/1988 | Neumann | 62/298 |
| 4,982,573 | A | * | 1/1991 | Tatematsu et al. | 62/135 |
| 4,984,360 | A | * | 1/1991 | Sather et al. | 29/890.053 |
| 4,986,081 | A | * | 1/1991 | Hida et al. | 62/130 |
| 5,052,469 | A | * | 10/1991 | Yanagimoto et al. | 164/465 |
| 5,123,260 | A | * | 6/1992 | Althoff et al. | 62/354 |
| 5,189,891 | A | * | 3/1993 | Sakamoto | 62/354 |
| 5,197,300 | A | * | 3/1993 | Sakamoto et al. | 62/354 |
| 5,394,708 | A | * | 3/1995 | Whinery et al. | 62/354 |
| 5,444,200 | A | * | 8/1995 | Ikari | 200/61.2 |
| 5,501,081 | A | * | 3/1996 | Mori et al. | 62/135 |
| 5,575,066 | A | * | 11/1996 | Cocchi | 29/890.035 |
| 5,974,823 | A | * | 11/1999 | Banno et al. | 62/354 |
| 6,134,908 | A | * | 10/2000 | Brunner et al. | 62/354 |
| 6,257,009 | B1 | * | 7/2001 | Tsuchikawa | 62/233 |
| 6,301,908 | B1 | * | 10/2001 | Huffman et al. | 62/137 |
| 6,343,416 | B1 | * | 2/2002 | Miller et al. | 29/890.035 |
| 6,619,067 | B2 | * | 9/2003 | Hiramatsu | 62/354 |

FOREIGN PATENT DOCUMENTS

| | | | |
|---|---|---|---|
| DE | 2539095 | A * | 3/1977 |
| EP | 000519252 | A1 * | 12/1992 |
| JP | 11-132610 | A1 | 5/1999 |
| JP | 02001263888 | A * | 9/2001 |

* cited by examiner

*Primary Examiner*—Denise Esquivel
*Assistant Examiner*—Mohammad M. Ali
(74) *Attorney, Agent, or Firm*—Rader, Fishman & Grauer PLLC

(57) ABSTRACT

A cooling unit adapted for use in a freezing mechanism, which is composed a metallic cylindrical evaporator housing and a metallic freezing pipe helically wound on an outer periphery of the evaporator housing for thermal contact with the evaporator housing, wherein the freezing pipe is embedded in a metal layer formed by slip casting of a low melting point alloy such as aluminum alloy, tin alloy or magnesium alloy on the outer periphery of the evaporator housing.

7 Claims, 3 Drawing Sheets

COOLING UNIT AND MANUFACTURING METHOD OF THE SAME

BACKGROUND OF THE INVENTION

1. Field of the Invention

The present invention relates to a cooling unit adapted for use in an auger type ice making machine, a freezing mechanism of an ice creamer or a freezing mechanism of the other type cooling equipment.

2. Description of the Prior Art

Disclosed in Japanese Patent Laid-open Publication No. 11 (1999)-132610 is a cooling unit used in an auger type ice making machine, wherein a metallic freezing pipe is helically wound on the outer periphery of a metallic cylindrical evaporator housing through a metallic filler for thermal contact with the evaporator housing. In the cooling unit, the metallic filler is embedded in a helical clearance between the evaporator housing and the freezing pipe to enhance the heat-exchange efficiency of the cooling unit.

It is, however, difficult to completely deposit the metallic filler into the helical clearance between the evaporator housing and the freezing pipe. If the metallic filler is partly chipped, an undesired clearance is formed between the evaporator housing and the freezing pipe. In addition, if the metallic filler causes corrosion of the evaporator housing at its embedded portion, there will occur an undesired clearance at the corroded portion of the evaporator housing. In such an instance, the air in the clearance is repeatedly expanded and contracted in operation and stopping of the cooling unit, and water entered into the clearance from the exterior is repeatedly frozen and melted in operation and stopping of the cooling unit. This results in enlargement of the undesired clearance between the evaporator housing and the freezing pipe and progress of the corrosion of the evaporator housing. The enlargement of undesired space in communication with the exterior causes local damage of the freezing pipe, resulting in leakage of refrigerant flowing therethrough and deteriorates the cooling performance of the unit.

SUMMARY OF THE INVENTION

It is, therefore, a primary object of the present invention to possibly eliminate the occurrence of an undesired clearance between the evaporator housing and the freezing pipe in the cooling unit and to avoid communication of an inevitably formed clearance with the exterior, thereby to enhance the cooling performance and durability of the cooling unit.

According to the present invention, the object is accomplished by providing a cooling unit adapted for use in a freezing mechanism, which comprises a metallic cylindrical evaporator housing and a metallic freezing pipe helically wound on an outer periphery of the evaporator housing for thermal contact with the evaporator housing, wherein the freezing pipe is embedded in a metal layer formed by slip casting of a low melting point alloy on the outer periphery of the evaporator housing.

In a practical embodiment of the present invention, it is preferable that the metal layer is formed by slip casting of an alloy whose melting point is lower than that of the material of the freezing pipe. Preferably, the low melting point alloy forming the metal layer is selected from a group consisting of aluminum alloy, tin alloy and magnesium alloy.

According to an aspect of the present invention, there is provided a manufacturing method of a cooling unit adapted for use in a freezing mechanism, comprising the steps of helically winding a metallic freezing pipe on an outer periphery of a metallic cylindrical evaporator housing in a closed relationship to provide a cooling unit assembly, setting the cooling unit assembly in a mold, and supplying a low melting point alloy in a melted condition into the mold and casting the alloy under reduced pressure in the mold to form a metal layer on the outer periphery of the evaporator housing in such a manner that the freezing pipe is embedded in the metal layer.

BRIEF DESCRIPTION OF THE DRAWINGS

Other objects, features and advantages of the present invention will be more readily appreciated from the following detailed description of a preferred embodiment thereof when taken together with the accompanying drawings, in which.

DESCRIPTION OF THE PREFERRED EMBODIMENT

Figure 1:
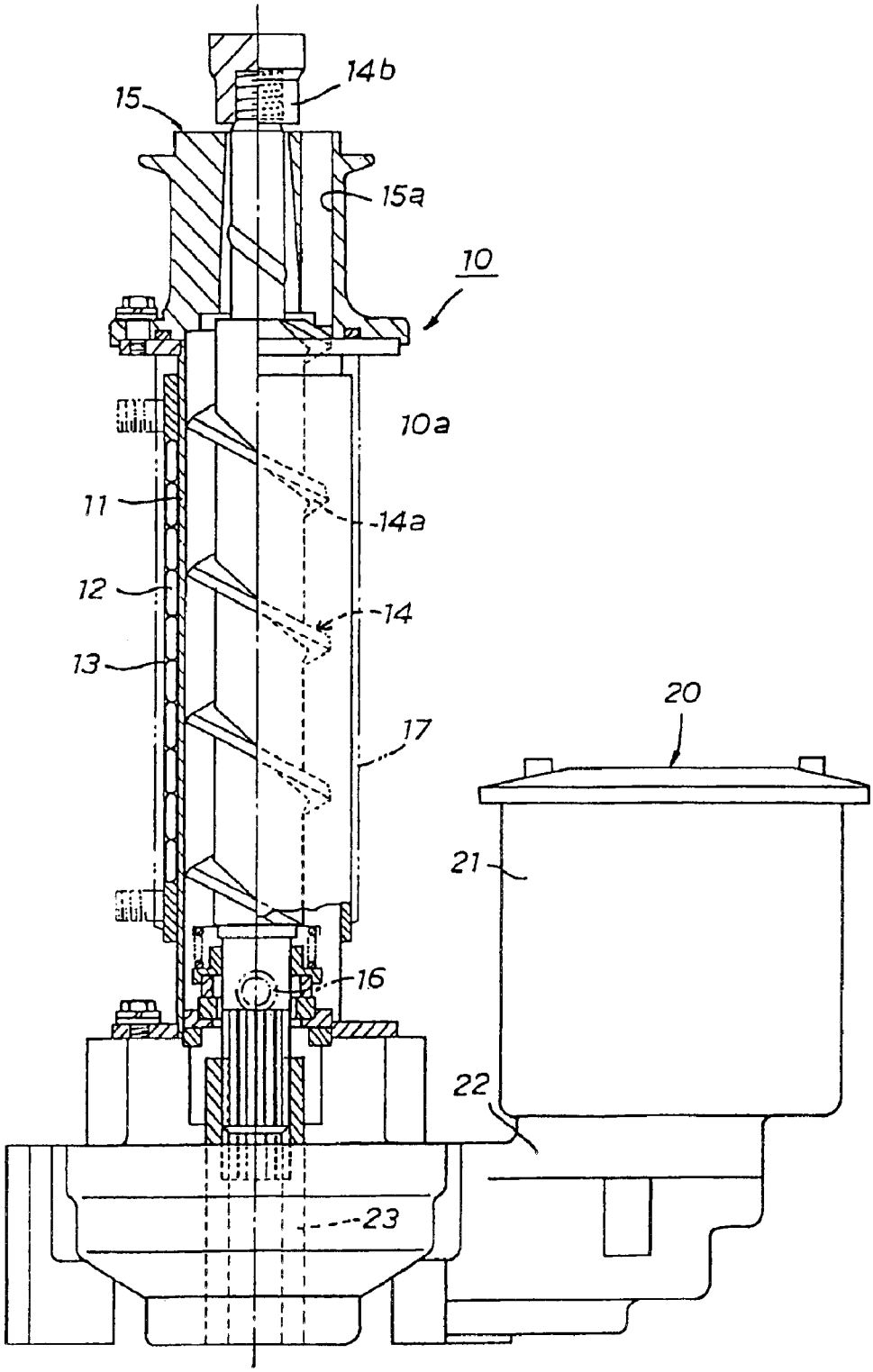
FIG. 1 is a vertical sectional view of an auger type ice making machine provided with a cooling unit in accordance with the present invention.

Illustrated in FIG. 1 of the drawings is an auger type ice making machine provided with a cooling unit in accordance with the present invention.

The ice making machine is composed of an ice making mechanism 10 and a drive mechanism 20. The ice making mechanism 10 includes a cooling unit 10*a* composed of a cylindrical evaporator housing 11 formed to contain an auger 14, a freezing pipe 12 helically wound on an outer periphery of the evaporator housing 11 and a metal layer 13 formed on the outer periphery of evaporator housing 11. The drive mechanism 20 includes an electric motor 21, a speed reduction gear train 22 and an output shaft 23 drivingly connected to the electric motor 21 through the speed reduction gear train 22. The auger 14 is mounted for rotary movement within the evaporator housing 11 and connected at its lower end to the output shaft 23 of the drive mechanism 20. The upper end of auger 14 is rotatably supported by means of an extrusion heat 15 mounted on the upper end of evaporator housing 11, and a cutter 14*b* is mounted on the upper end of auger 14 for rotation therewith.

In operation of the ice making machine, fresh water for ice is supplied into the evaporator housing 11 through an inlet port 16 and stored in the evaporator housing 11 at a predetermined level, while the electric motor 21 is activated to rotate the auger 14. The supplied fresh water is chilled by refrigerant flowing through the freezing pipe 12 to form ice crystals on the internal surface of evaporator housing 11. The ice crystals are scraped by a helical blade 14*a* of auger 14, and the scraped ice crystals are advanced upward toward the upper end of evaporator housing 11 and compressed in the course of passing through compression passages 15*a* of extrusion head 15. The compressed ice crystals are continuously extruded in the form of rods of dehydrated ice from the compression passages 15*a* of extrusion head 15 and broken by the cutter 14*b* into ice blocks. Thus, the ice blocks are discharged from a discharge duct (not shown) of the ice making machine.

Figure 2:
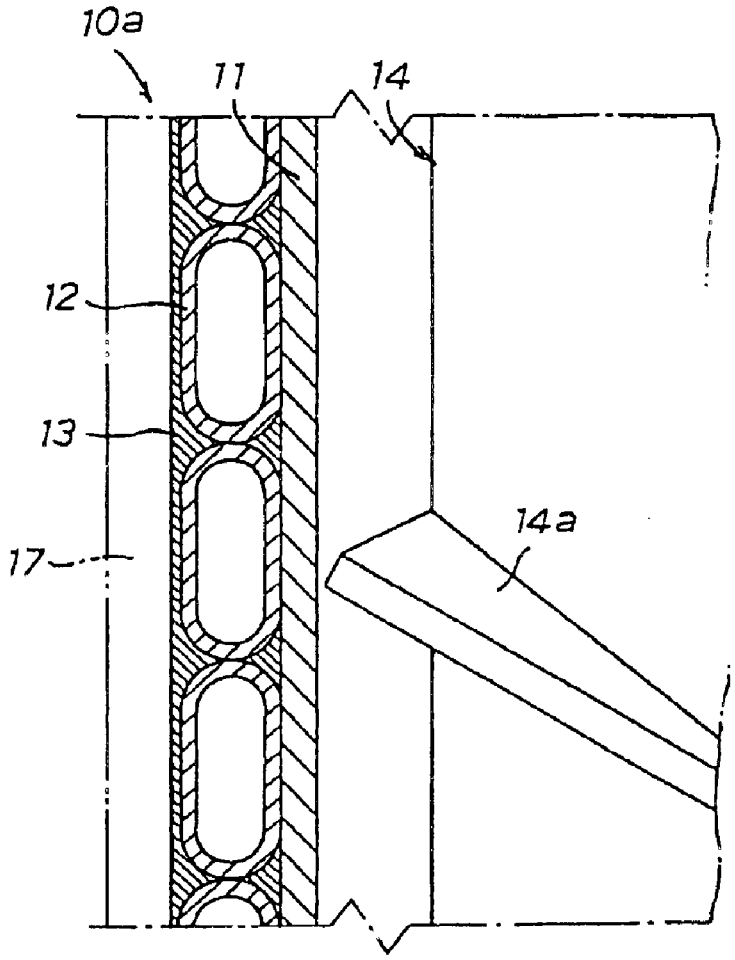
FIG. 2 is a partly enlarged sectional view of the cooling unit shown in FIG. 1.

In the cooling unit 10*a*, the evaporator housing 11 is in the form of a cylindrical body made of stainless steel, the freezing pipe 12 is made of copper, and the metal layer 13 is formed in desired thickness by slip casting of an alloy whose melting point is lower than that of copper. As clearly illustrated in FIG. 2, the freezing pipe 12 is helically wound on the outer periphery of evaporator housing 11 in a closed relationship and is completely embedded in the metal layer 13 formed on the outer periphery of evaporator housing 11. The metal layer 13 is formed by slip casting of light alloy in a melted condition and filled in a number of spaces inevitably formed between the evaporator housing 11 and the freezing pipe 12. In addition, the cooling unit 10*a* is covered with a heat insulation material 17 in a usual manner.

In a practical embodiment of the present invention, it is desirable that low melting point alloy superior in anti-corrosion and anti-thermal fatigue properties such as tin alloy, aluminum alloy, magnesium alloy is used as the material of the metal layer 13. For example, it is preferable that the tin alloy is in the form of Sn—Ag alloy containing 96.5 wt % Sn and 3.5 wt % (melting point: 221° C.) or Sn—Ag—Cu alloy containing 95.5 wt % Sn, 3.5 wt % Ag and 1.0 wt % Cu (melting point: 217° C.). Alternatively, Al—Si—Mg (AC4C, melting point: 610° C.) may be used as the aluminum alloy or a rare earth alloy such as Mg—Al, Mg—Zn or Mg may be used as the magnesium alloy.

In a slip casting process of the metal layer 13, the low melting point alloy in a melted condition flows into a clearance between the evaporator housing 11 and the freezing pipe 12 and fills in the clearance. This is useful to eliminate an undesired cavity caused by the clearance in the metal layer 13. Even if an undesired cavity was slightly formed in the metal layer 13, air communication of the cavity with the exterior would be interrupted by the anti-corrosive metal layer 13. Accordingly, the occurrence of undesired cavity caused by a clearance between the evaporator housing 11 and the freezing pipe 12 can be avoided utmost, and air communication of an inevitably formed cavity to the exterior can be eliminated. This is useful to prevent damage or corrosion of the freezing pipe 12 thereby to maintain the cooling performance of the freezing pipe 12 for a long period of time.

Figure 3:
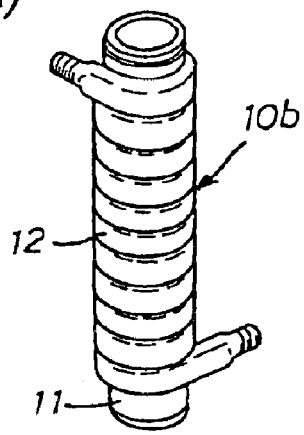
FIGS. 3(*a*)–3(*c*) illustrate a manufacturing process of the cooling unit shown in FIG. 1.
Figure 3:
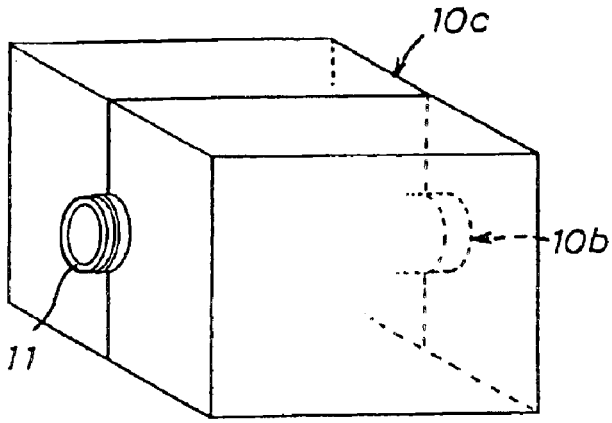
Figure 3:
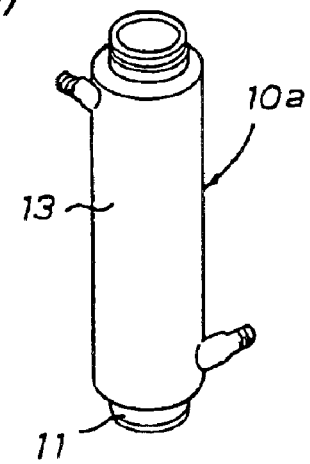

Illustrated in FIGS. 3(*a*)–3(*c*) is a manufacturing process of the cooling unit 10*a*, wherein the freezing pipe 12 of copper is spirally wound on the outer periphery of the cylindrical evaporator housing 11 in a closed relationship to provide a cooling unit assembly 10*b* as shown in FIG. 3(*a*). The cooling unit assembly 10*b* is set in a split type casting mold 10*c* as shown in FIG. 3(*b*), and the low melting point alloy in a melted condition is supplied into the casing mold 10*c* and cast under reduced pressure in the mold to form a metal layer 13 on the outer periphery of evaporator housing 11 in such a manner that the freezing pipe 12 is completely embedded in the metal layer 13. In the slip casting process, the melted alloy flows into a clearance between the evaporator housing 11 and the freezing pipe 12 and fills in the clearance to prevent the occurrence of a cavity in the metal layer 13. Thus, the cooling unit 10*a* is manufactured as shown in FIG. 3(*c*).

What is claimed is:

1. A cooling unit adapted for use in a freezing mechanism, comprising a metallic cylindrical evaporator housing and a metallic freezing pipe helically wound on an outer periphery of the evaporator housing forming a series of coil segments for thermal contact with the evaporator housing, wherein consecutive ones of the coil segments contact each other along a helically shaped line of contact defining a first freezing pipe surface section facing exteriorly relative to the line of contact and a space-formed between the contacting coil segments, respective second freezing pipe surface sections of the consecutive ones of the coil segments facing interiorly relative to the line of contact and the outer periphery of the evaporator housing, wherein said freezing pipe is embedded in a metal layer formed by slip casting of a low melting point alloy, the low melting point alloy completely filling the space and completely covering the first freezing pipe surface section.

2. A cooling unit as claimed in claim 1, wherein the metal layer is formed by slip casting of an alloy whose melting point is lower than that of the material of said freezing pipe.

3. A cooling unit as claimed in claim 2, wherein the low melting point alloy forming the metal layer is selected from a group consisting of aluminum alloy, tin alloy and magnesium alloy.

4. A cooling unit adapted for use in a freezing mechanism of an auger type ice making machine, comprising a metallic cylindrical evaporator housing formed to contain an auger and a metallic freezing pipe helically wound on an outer periphery of the evaporator housing forming a series of coil segments for thermal contact with the evaporator housing, wherein consecutive ones of the coil segments contact each other with portions of each contacting coil segment and the outer periphery of the evaporator housing defining a space and said freezing pipe is embedded in a metal layer formed by slip casting of a low melting point alloy, the low melting point alloy completely filling the space thereby being in complete contact with the portions of each contacting coil segment and the outer periphery of the evaporator housing defining the space and completely covering a surface of the metallic freezing pipe facing exteriorly relative to the evaporator housing.

5. A manufacturing method of a cooling unit adapted for use in a freezing mechanism, comprising the steps of:

helically winding a metallic freezing pipe on an outer periphery of a metallic cylindrical evaporator housing in a closed relationship to provide a cooling unit assembly;

setting the cooling unit assembly in a mold; and supplying a low melting point alloy in a melted condition into the mold and casting the alloy in the mold to form a metal layer on the outer periphery of the evaporator housing in such a manner that the freezing pipe is embedded in the metal layer.

6. A manufacturing method of a cooling unit as claimed in claim 5, wherein the low melting point alloy in the melted condition is cast under reduced pressure in the mold to form the metal layer on the outer periphery of the evaporator housing.

7. A cooling unit adapted for use in a freezing mechanism, comprising:

a metallic cylindrical evaporator housing having an outer periphery;

a metallic freezing pipe helically wound on the outer periphery for thermal contact with the evaporator housing, the metallic freezing pipe forming a series of coil segments such that consecutive ones of the coil segments contact each other along a helically shaped line of contact to define a first freezing pipe surface section facing exteriorly relative to the line of contact and a space formed between contacting coil segment portions of the metallic freezing pipe defined by respective second freezing pipe surface sections of the consecutive ones of the coil segments facing interiorlyrelative to the line of contact and the outer periphery of the evaporator housing; and a metal layer of a low melting point alloy completely encasing the first freezing pipe surface section and the low melting point alloy completely filling the space.

* * * * *